US009993701B2

(12) United States Patent
Takagi et al.

(10) Patent No.: US 9,993,701 B2
(45) Date of Patent: Jun. 12, 2018

(54) GOLF CLUB HEAD

(71) Applicant: BRIDGESTONE SPORTS CO., LTD., Tokyo (JP)

(72) Inventors: Masaya Takagi, Tokyo (JP); Hiroshi Takahashi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days. days.

(21) Appl. No.: 15/460,586

(22) Filed: Mar. 16, 2017

(65) Prior Publication Data

US 2017/0304689 A1 Oct. 26, 2017

(30) Foreign Application Priority Data

Apr. 20, 2016 (JP) ..... 2016-084452

(51) Int. Cl.

*A63B 53/04* (2015.01)
*A63B 53/06* (2015.01)
*A63B 60/52* (2015.01)
*A63B 60/02* (2015.01)

(52) U.S. Cl.

CPC ..... *A63B 53/0466* (2013.01); *A63B 53/06* (2013.01); *A63B 60/52* (2015.10); *A63B 60/02* (2015.10); *A63B 2053/045* (2013.01); *A63B 2053/0408* (2013.01); *A63B 2053/0433* (2013.01); *A63B 2053/0454* (2013.01); *A63B 2053/0491* (2013.01)

(58) Field of Classification Search

USPC ..... 473/324–350
See application file for complete search history.

(56) References Cited

U.S. PATENT DOCUMENTS 5,437,456 A * 8/1995 Schmidt ..... A63B 53/04 473/290
5,626,530 A * 5/1997 Schmidt ..... A63B 53/04 473/324
5,749,795 A * 5/1998 Schmidt ..... A63B 53/04 473/329
6,348,013 B1 * 2/2002 Kosmatka ..... A63B 53/04 473/329
6,645,087 B2 * 11/2003 Yabu ..... A63B 53/0466 473/342
7,294,064 B2 * 11/2007 Tsurumaki ..... A63B 53/0466 473/329
8,231,481 B2 * 7/2012 Takechi ..... A63B 53/0466 473/342

(Continued)

FOREIGN PATENT DOCUMENTS

JP 04180778 A * 6/1992
JP 06190088 A * 7/1994

(Continued)

*Primary Examiner* — Alvin Hunter
(74) *Attorney, Agent, or Firm* — IPUSA, PLLC

(57) ABSTRACT

A golf club head having a hollow structure includes a face, an internal surface, and an external surface. The face defines a front portion of the golf club head and includes a face surface defining a ball-striking surface. The internal surface includes an internal depression that at least partly extends along the outline of the face surface. The external surface includes an external depression that at least partly extends along the outline of the face surface.

16 Claims, 4 Drawing Sheets

(56) References Cited

U.S. PATENT DOCUMENTS

| | | | | |
|---|---|---|---|---|
| 8,235,841 | B2 * | 8/2012 | Stites | A63B 53/0466 473/328 |
| 8,403,771 | B1 * | 3/2013 | Rice | A63B 53/04 473/328 |
| 8,435,134 | B2 * | 5/2013 | Tang | A63B 53/04 473/329 |
| 8,465,380 | B2 * | 6/2013 | Horacek | A63B 53/0466 473/329 |
| 8,517,860 | B2 * | 8/2013 | Albertsen | A63B 53/0466 473/329 |
| 8,821,312 | B2 * | 9/2014 | Burnett | A63B 53/0466 473/329 |
| 8,858,360 | B2 * | 10/2014 | Rice | A63B 53/04 473/329 |
| 9,017,187 | B2 * | 4/2015 | Abe | A63B 53/0466 473/329 |
| 2007/0275792 | A1 | 11/2007 | Horacek et al. | |
| 2010/0029404 | A1 | 2/2010 | Shear | |
| 2011/0021284 | A1 | 1/2011 | Stites et al. | |
| 2011/0218053 | A1 | 9/2011 | Tang et al. | |
| 2012/0220389 | A1 | 8/2012 | Hoffman et al. | |
| 2012/0270676 | A1 | 10/2012 | Burnett et al. | |
| 2014/0038745 | A1 | 2/2014 | Abe | |
| 2014/0045611 | A1 | 2/2014 | Morales et al. | |
| 2014/0080625 | A1 | 3/2014 | Fossum et al. | |
| 2014/0342848 | A1 | 11/2014 | Burnett et al. | |

FOREIGN PATENT DOCUMENTS

| | | | | | |
|---|---|---|---|---|---|
| JP | 10263118 | A | * | 10/1998 | |
| JP | 11114102 | A | * | 4/1999 | |
| JP | 2000-317018 | | | 11/2000 | |
| JP | 2001129131 | A | * | 5/2001 | |
| JP | 2002052099 | A | * | 2/2002 | |
| JP | 2002239040 | A | * | 8/2002 | |
| JP | 2003024481 | A | * | 1/2003 | |
| JP | 2004351054 | A | * | 12/2004 | |
| JP | 2005-073736 | | | 3/2005 | |
| JP | 2005193069 | A | * | 7/2005 | |
| JP | 2006094965 | A | * | 4/2006 | |
| JP | 2007136069 | A | * | 6/2007 | |
| JP | 2007-313330 | | | 12/2007 | |
| JP | 2010279847 | A | * | 12/2010 | |
| JP | 2013165962 | A | * | 8/2013 | |
| JP | 2014-027973 | | | 2/2014 | |
| JP | 2014027973 | A | * | 2/2014 | A63B 53/0466 |
| JP | 2014-087570 | | | 5/2014 | |
| JP | 2014087570 | A | * | 5/2014 | |
| JP | 2015-107339 | | | 6/2015 | |
| JP | 2015-528383 | | | 9/2015 | |
| JP | 2017060900 | A | * | 3/2017 | A63B 53/0466 |

* cited by examiner

GOLF CLUB HEAD

CROSS-REFERENCE TO RELATED APPLICATION

This application is based upon and claims priority to Japanese Patent Application No. 2016-084452, filed on Apr. 20, 2016, the entire contents of which are incorporated herein by reference.

BACKGROUND OF THE INVENTION

1. Field of the Invention

The present invention relates to golf club heads.

2. Description of the Related Art

Various techniques have been studied to improve head functions of a golf club head, such as performance in off-center hits. Such techniques that improve head functions are described in, for example, Japanese National Publication of International Patent Application No. 2015-528383, Japanese Laid-Open Patent Application Nos. 2015-107339, 2014-087570, 2014-027973, 2005-073736, 2007-313330, and 2000-317018, and U.S. Patent Application Publication Nos. 2014/0342848, 2014/0045611, 2012/0270676, 2011/0218053, 2010/0029404, and 2012/0220389. To improve head functions of a golf club head, it is desired to give sufficient consideration to the deflectability of the face of the golf club head. Furthermore, it is also desired to prevent a user of the golf club from having a feeling of strangeness at address.

SUMMARY OF THE INVENTION

According to an aspect of the present invention, a golf club head having a hollow structure includes a face, an internal surface, and an external surface. The face defines a front portion of the golf club head and includes a face surface defining a ball-striking surface. The internal surface includes an internal depression that at least partly extends along the outline of the face surface. The external surface includes an external depression that at least partly extends along the outline of the face surface.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF THE PREFERRED EMBODIMENTS

Figure 1A:
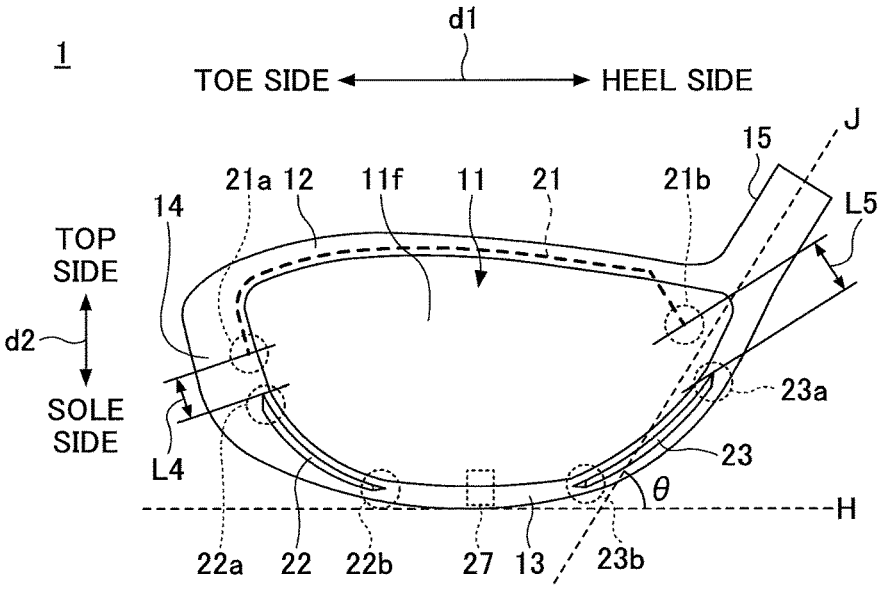
FIGS. 1A through 1D are diagrams depicting a golf club head according to an embodiment.

According to an aspect of the present invention, a golf club head including a face with improved deflectability is provided.

One or more embodiments of the present invention are described below with reference to the accompanying drawings. In the following description, the same elements are referred to using the same reference numeral, and a repetitive description thereof may be omitted.

FIGS. 1A through 1D are a front elevational view, a bottom (sole side) view, a left side (toe side) elevational view, and a right side (heel side) elevational view, respectively, of a golf club head 1 according to an embodiment.

Figure 1B:
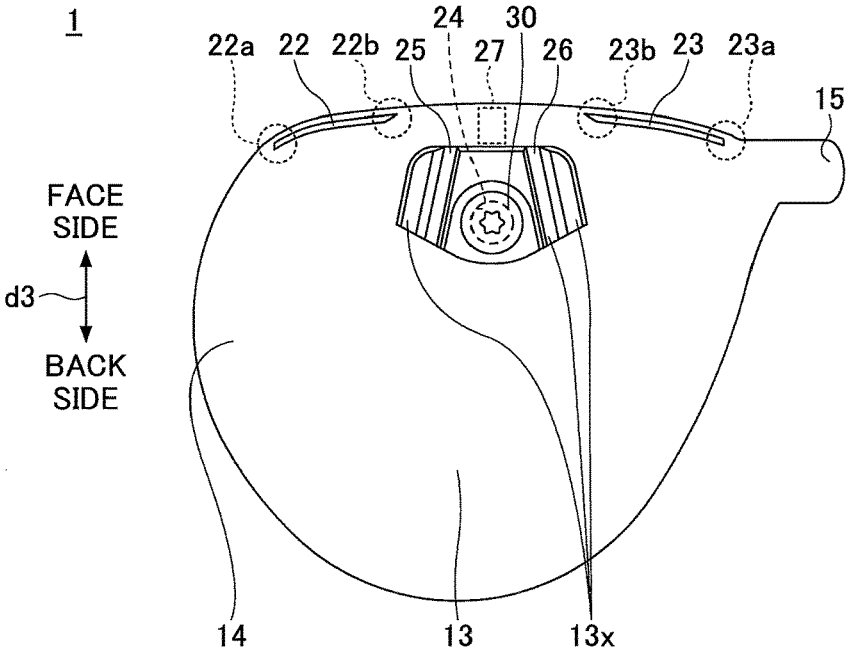
Figure 1C:
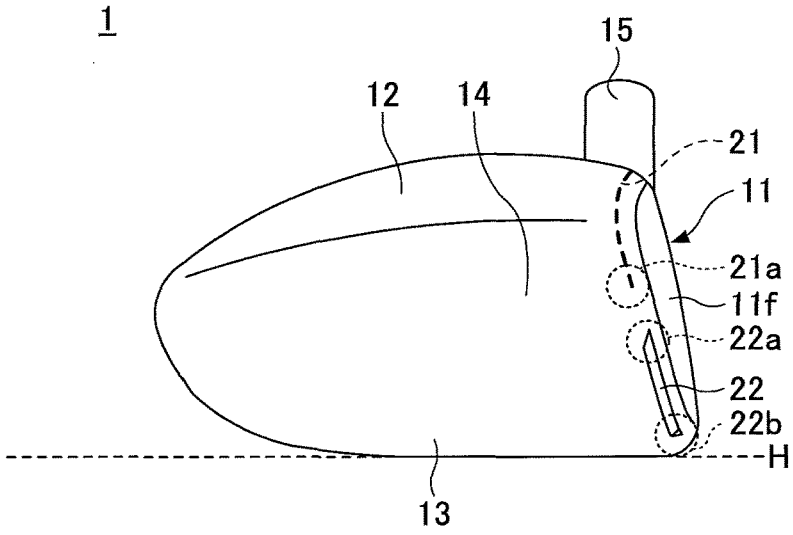
Figure 1D:
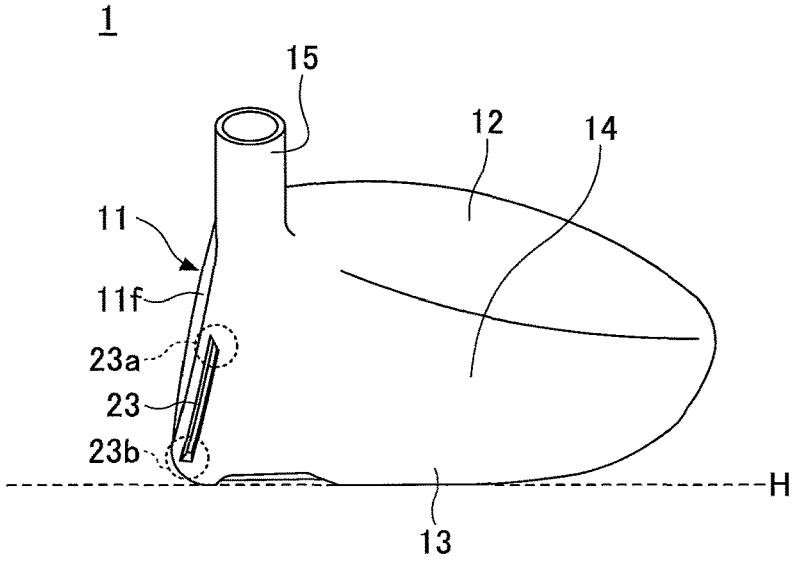

The front elevational view of FIG. 1A is a view taken from the side of a face surface 11*f* of the golf club head 1 (that is, looking at the face surface 11*f*), depicting the golf club head 1 resting (soled) on a horizontal plane H (corresponding to a ground plane) at a reference lie angle θ and a reference loft angle (not depicted). In FIG. 1A, a central axis of a bore of a hosel 15 is indicated by a dashed line J. In FIGS. 1A and 1B, a double-headed arrow d1 indicates the "toe-heel" (left-right) direction, namely, the direction from the toe side to the heel side or the direction from the heel side to the toe side, of the golf club head 1, a double-headed arrow d2 indicates the "top-sole" (up-down) direction, namely, the direction from the top side to the sole side or the direction from the sole side to the top side, of the golf club head 1, and a double-headed arrow d3 indicates the "face-back" (front-rear) direction, namely, the direction from the face side to the back side or the direction from the back side to the face side, of the golf club head 1.

The golf club head 1 depicted in FIGS. 1A through 1D is a wood-type golf club head such as a driver club head, but may also be a hybrid club head or a fairway wood club head. The golf club head 1 may be made of a metal material such as a titanium alloy, titanium, stainless steel, or beryllium copper. Multiple parts may be joined and assembled into the golf club head 1. The golf club head 1 is described in more detail below.

The golf club head 1 is a hollow structure that includes a face 11, a crown 12, a sole 13, a sidewall 14, and the hosel 15. An internal surface of the hollow structure may be referred to as "head internal surface" and an external surface of the hollow structure may be referred to as "head external surface."

The face 11 defines a front portion of the golf club head 1, and includes the face surface 11*f*, which defines a ball-striking surface between the crown 12 and the sole 13 in the top-sole direction. The face 11 has a predetermined thickness. The face surface 11*f* forms an external surface of the face 11. The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 11*f*. The hosel 15 receives a shaft.

Figure 2:
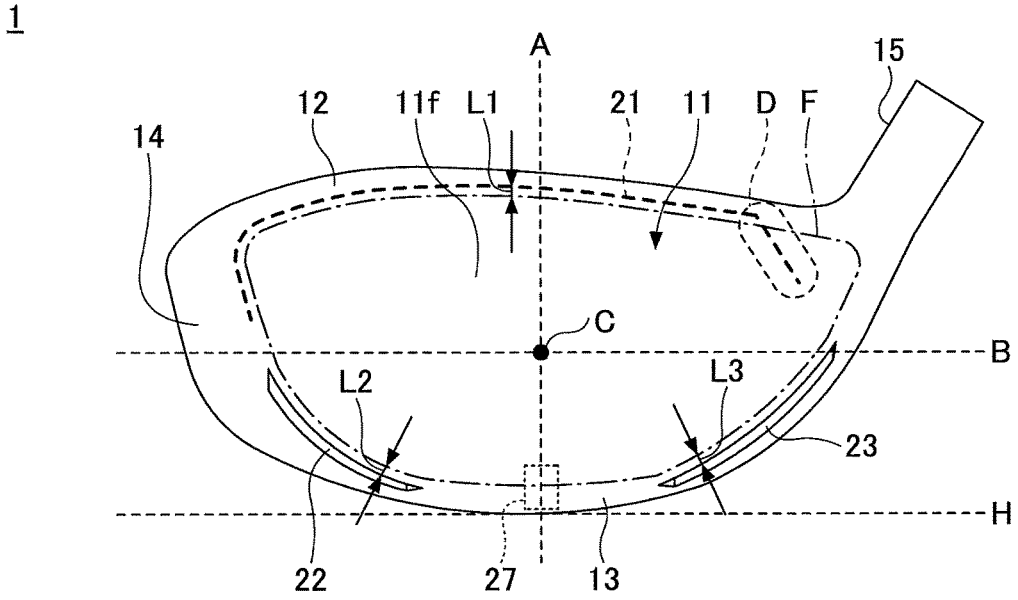
FIG. 2 is a front elevational view of the golf club head, illustrating a positional relationship between an outline of a face surface and depressions of the golf club head according to the embodiment.
Figure 3:
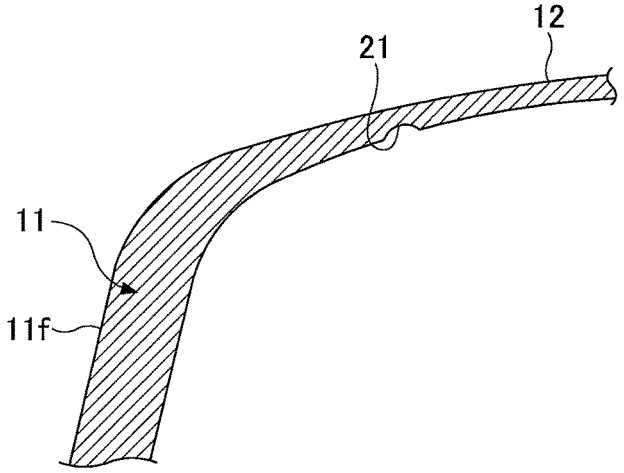
FIG. 3 is a partial enlarged end view of the golf club head according to the embodiment.
Figure 4:
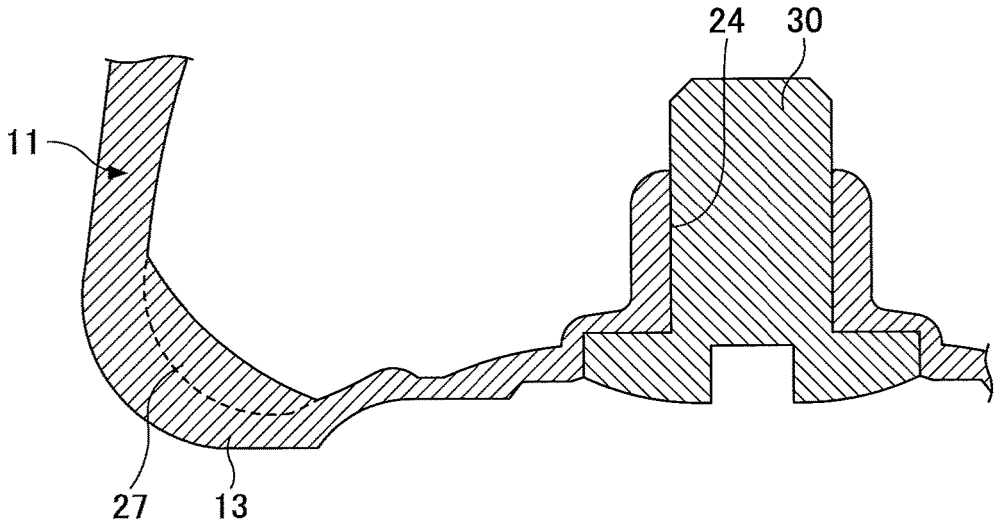
FIG. 4 is a partial enlarged end view of the golf club head according to the embodiment.

FIG. 2 is a front elevational view of the golf club head 1, illustrating a positional relationship between an outline (perimeter) F of the face surface 11*f* and depressions of the golf club head 1. FIG. 3 is a partial enlarged end view of the golf club head 1, depicting a cross section of part of the face 11 and part of the crown 12 along a plane in a direction perpendicular to the plane of paper of FIG. 2 (the face-back direction) at the position of a dashed line A. FIG. 4 is a partial enlarged end view of the golf club head 1, depicting a cross section of part of the face 11 and part of the sole 13 along the plane in the face-back direction at the position of the dashed line A.

The dashed line A is a straight line that is perpendicular to the horizontal plane H and divides the outline F of the face surface 11*f* into halves in the toe-heel direction in the plane of paper of FIG. 2.

Furthermore, a dashed line B of FIG. 2 is a straight line that is parallel to the horizontal plane H and divides the outline F of the face surface 11*f* into halves in the top-sole direction in the plane of paper of FIG. 2. An intersection C of the straight lines A and B in the plane of paper of FIG. 2 is the center of the face surface 11*f* (face center).

Referring to FIGS. 1A through 1D, 2 and 3, the golf club head 1 includes an internal depression 21 that partly extends along the outline F of the face surface 11*f*. In FIG. 2, a portion of the internal depression 21 that does not extend along the outline F of the face surface 11*f* is enclosed by a dashed line D. A minimum distance L1 between the internal depression 21 except for the portion enclosed by the dashed line D and the outline F of the face surface 11*f* is preferably more than or equal to 5 mm and less than or equal to 15 mm (5 mm≤L1≤15 mm).

The internal depression 21, which is invisible to have its position indicated by a dashed line in FIGS. 1A through 1D and 2, is a groove formed in the head internal surface to be depressed toward the head external surface as depicted in FIG. 3. The internal depression 21 includes an internal depression toe end 21*a* and an internal depression heel end 21*b*, which define the toe-side end and the heel-side end, respectively, of the internal depression 21. The internal depression toe end 21*a* is located on an internal surface of the sidewall 14 (part of the internal head surface). The internal depression heel end 21*b* is located on a rear surface of the face 11 (part of the internal head surface).

The internal depression 21 does not have to be a single continuous groove, and may be divided into multiple portions as required. For example, the internal depression 21 may be formed of two independent grooves.

Referring to FIGS. 1A through 1D and 2, the golf club head 1 includes an external toe depression 22 and an external heel depression 23 that extend along the outline F of the face surface 11*f*. The external toe depression 22 is a groove formed in the head external surface on the toe side to be depressed toward the head internal surface. The external heel depression 23 is a groove formed in the head external surface on the heel side to be depressed toward the head internal surface.

Thus, the golf club head 1 includes the internal depression 21 provided in the crown 12 and part of a sidewall-side portion, and the external toe depression 22 and the external heel depression 23 provided in the sidewall-side portion. The golf club head 1 has no depression along the outline F of the face surface 11*f* at a position where a sole-side portion intersects with the straight line A of FIG. 2. Here, the sole-side portion of the golf club head 1 refers to a periphery of the face surface 11*f* on the sole 13 side and a portion of the face surface 11*f* adjoining to the periphery of the face surface 11*f* on the sole 13 side. Furthermore, the sidewall-side portion of the golf club head 1 refers to a periphery of the face surface 11*f* on the sidewall 14 side and a portion of the face surface 11*f* adjoining to the periphery of the face surface 11*f* on the sidewall 14 side.

A minimum distance L2 between the external toe depression 22 and the outline F of the face surface 11*f* is preferably more than or equal to 2 mm and less than or equal to 10 mm (2 mm≤L2≤10 mm). A minimum distance L3 between the external heel depression 23 and the outline F of the face surface 11*f* is preferably more than or equal to 2 mm and less than or equal to 10 mm (2 mm≤L3≤10 mm). The external toe depression 22 and the external heel depression 23 may be collectively referred to as "external depression."

The external toe depression 22 and the external heel depression 23 are disposed at positions invisible from above (the crown 12 side) when the golf club head 1 is soled (grounded) at a reference lie angle and a reference loft angle. As a result, when a user of the golf club head 1 is at address, the external toe depression 22 and the external heel depression 23 are invisible to the user. Accordingly, the user can address the ball without having a feeling of strangeness.

The external toe depression 22 includes an external toe depression upper end 22*a* and an external toe depression lower end 22*b*, which define the top-side end and the sole-side end, respectively, of the external toe depression 22. Likewise, the external heel depression 23 includes an external heel depression upper end 23*a* and an external heel depression lower end 23*b*, which define the top-side end and the sole-side end, respectively, of the external heel depression 23.

The external toe depression upper end 22*a* is positioned near the internal depression toe end 21*a*. Specifically, the external toe depression upper end 22*a* and the internal depression toe end 21*a* are disposed so that a minimum distance L4 between the external toe depression upper end 22*a* and the internal depression toe end 21*a* is more than or equal to 3 mm and less than or equal to 30 mm (3 mm≤L4≤30 mm). Furthermore, the external heel depression upper end 23*a* is positioned near the internal depression heel end 21*b*. Specifically, the external heel depression upper end 23*a* and the internal depression heel end 21*b* are disposed so that a minimum distance L5 between the external heel depression upper end 23*a* and the internal depression heel end 21*b* is more than or equal to 3 mm and less than or equal to 30 mm (3 mm≤L5≤30 mm).

Thus, according to the golf club head 1, the internal depression 21 includes the internal depression toe end 21*a* and the internal depression heel end 21*b*. This makes it possible to reduce the distance between the external toe depression upper end 22*a* of the external toe depression 22 and the internal depression 21 and the distance between the external heel depression upper end 23*a* of the external heel depression 23 and the internal depression 21, and to surround most of the outline F of the face surface 11*f* with depressions from the toe side to the crown side to the heel side.

The internal depression 21 serves to cause a deflection of the face 11 on the crown 12 side and a local deflection of the face 11 on the sidewall 14 side during impact. Furthermore, the external toe depression 22 and the external heel depression 23 serve to cause a local deflection of the face 11 on the sidewall 14 side during impact.

As described above, the golf club head 1 includes the internal depression 21 provided in the crown 12 and part of the sidewall-side portion, and the external toe depression 22 and the external heel depression 23 provided in the sidewall-side portion. Accordingly, it is possible to cause a large deflection of the face 11 on the crown 12 side and the sidewall 14 side during impact. As a result, it is possible to increase the launch angle of a ball struck with the face surface 11*f* and to increase a repulsive force in the case of off-center hits.

Referring to FIGS. 1A through 1D, each of the external toe depression 22 and the external heel depression 23 extends in its entirety along the outline F of the face surface 11*f*. The external toe depression 22 and the external heel depression 23, however, are not limited to this configuration, and one or both of the external toe depression 22 and the external heel depression 23 may include a portion that does not extend along the outline F of the face surface 11*f* as the portion of the internal depression 21 enclosed by the dashed line D.

Referring to FIGS. 1A through 1D and 4, an attachment part 24 to which a weight 30, which is a head weight adjustment part, is attachable is provided in the sole 13. FIG. 1B depicts the attachment part 24 to which the weight 30 is attached. The weight 30 is removably attached, and a desired weight may be suitably attached as required. (That is, the weight 30 is an optional element of the golf club head 1.) The position of the center of gravity of the golf club head 1 can be adjusted by weight adjustment using the weight 30.

A sole depression 13*x* is formed in the head external surface in the periphery of the attachment part 24 in the sole 13. Elongated external ribs 25 and 26 projecting from the head external surface are disposed on the opposite sides of the attachment part 24 from each other in the toe-heel direction in the sole depression 13*x* in a bottom view. The external ribs 25 and 26 are inclined to gradually reduce the distance between the external ribs 25 and 26 toward the face side from the back side in a bottom view.

An internal rib 27 projecting from the head internal surface is disposed on an internal surface of the sole 13. The internal rib 27 is positioned (substantially midway) between the external ribs 25 and 26 in the toe-heel direction and closer to the face surface 11*f* relative to the external ribs 25 and 26 in a bottom view. The internal rib 27, which is invisible to have its position indicated by a dashed line in FIGS. 1A and 1B, is a projection projecting inward from the head internal surface as depicted in FIG. 4. (The internal rib 27 lies inside the dashed line in FIGS. 1A and 1B.) Furthermore, as depicted in FIG. 4, the attachment part 24 includes a screw hole for attaching the weight 30.

The external ribs 25 and 26 and the internal rib 27 are disposed between the external toe depression lower end 22*b* of the external toe depression 22 and the external heel depression lower end 23*b* of the external heel depression 23 in the toe-heel direction.

By thus providing the external ribs 25 and 26 and the internal rib 27 on the sole 13, it is possible to further increase the stiffness of the golf club head 1 on the sole 13 side. As a result, it is possible to enhance the above-described launch angle increasing effect due to the internal depression 21, the external toe depression 22, and the external heel depression 23, and the above-described repulsive force increasing effect in the case of off-center hits.

Furthermore, because the external ribs 25 and 26 are provided in the sole depression 13*x*, the external ribs 25 and 26 do not project from the head external surface. Therefore, the address position of the golf club head 1 can be stabilized.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, the hosel 15 may be configured to allow a sleeve fixed to the end of a shaft to be removably attached to the hosel 15. Use of the sleeve facilitates replacement of the shaft. Furthermore, the axis of a shaft insertion hole provided in the sleeve may be inclined relative to the central axis of the bore of the hosel 15. In this case, it is possible to change the lie angle or loft angle by rotating the sleeve about its axis to change a position at which the sleeve fits to the hosel 15.

What is claimed is:

1. A golf club head having a hollow structure, the golf club head comprising:

a face defining a front portion of the golf club head and including a face surface defining a ball-striking surface;

an internal surface including an internal depression, the internal depression at least partly extending along an outline of the face surface;

an external surface including an external depression, the external depression at least partly extending along the outline of the face surface;

a crown defining a top portion of the golf club head; and a sole defining a bottom portion of the golf club head, wherein the external depression includes a toe-side external depression closer to a toe of the golf club head than to a heel of the golf club head, and a heel-side external depression closer to the heel than to the toe, wherein the internal depression includes a first end closer to the toe than to the heel, and a second end closer to the heel than to the toe, wherein the toe-side external depression includes a third end closer to the crown than to the sole and a fourth end closer to the sole than to the crown, the third end being positioned near the first end, wherein the heel-side external depression includes a fifth end closer to the crown than to the sole and a sixth end closer to the sole than to the crown, the fifth end being positioned near the second end, and wherein a minimum distance between the third end and the first end is more than or equal to 3 mm and less than or equal to 30 mm, and a minimum distance between the fifth end and the second end is more than or equal to 3 mm and less than or equal to 30 mm.

2. The golf club head as claimed in claim 1, wherein a sole-side portion of the golf club head is devoid of a depression along the outline of the face surface at a position at which the sole-side portion intersects with a straight line perpendicular to a horizontal plane on which the golf club head rests at a reference lie angle and a reference loft angle, the straight line extending in a direction from the crown to the sole through a center of the face surface.

3. The golf club head as claimed in claim 1, wherein the external depression is disposed at a position invisible in a view from above the crown with the golf club head resting on a horizontal plane at a reference lie angle and a reference loft angle.

4. The golf club head as claimed in claim 1, wherein the second end is positioned on a rear surface of the face.

5. The golf club head as claimed in claim 1, further comprising:

a rib disposed on the sole.

6. The golf club head as claimed in claim 5, wherein the rib is disposed between the toe-side external depression and the heel-side external depression in a direction from the toe to the heel.

7. The golf club head as claimed in claim 5, wherein the rib includes an internal rib projecting from the internal surface and an external rib projecting from the external surface.

8. The golf club head as claimed in claim 7, wherein a depression is formed in the external surface in the sole, and the external rib is disposed in the depression.

9. A golf club head having a hollow structure, the golf club head comprising:

a face defining a front portion of the golf club head and including a face surface defining a ball-striking surface;

an internal surface including an internal depression, the internal depression at least partly extending along an outline of the face surface;

an external surface including an external depression, the external depression at least partly extending along the outline of the face surface; and a sole defining a bottom portion of the golf club head, wherein the external depression includes a toe-side external depression closer to a toe of the golf club head than to a heel of the golf club head, and a heel-side external depression closer to the heel than to the toe, and wherein a sole-side portion of the golf club head is devoid of a depression in a region along the outline of the face surface between the toe-side external depression and the heel-side external depression.

10. The golf club head as claimed in claim 9, further comprising:

a crown defining a top portion of the golf club head, wherein the sole-side portion of the golf club head is devoid of the depression at a position at which the sole-side portion intersects with a straight line perpendicular to a horizontal plane on which the golf club head rests at a reference lie angle and a reference loft angle, the straight line extending in a direction from the crown to the sole through a center of the face surface.

11. The golf club head as claimed in claim 9, further comprising:

a crown defining a top portion of the golf club head, the external depression is disposed at a position invisible in a view from above the crown with the golf club head resting on a horizontal plane at a reference lie angle and a reference loft angle.

12. The golf club head as claimed in claim 9, wherein the internal depression includes a first end closer to the toe than to the heel, and a second end closer to the heel than to the toe, and the second end is positioned on a rear surface of the face.

13. The golf club head as claimed in claim 9, further comprising:

a rib disposed on the sole.

14. The golf club head as claimed in claim 13, wherein the rib is disposed between the toe-side external depression and the heel-side external depression in a direction from the toe to the heel.

15. The golf club head as claimed in claim 13, wherein the rib includes an internal rib projecting from the internal surface and an external rib projecting from the external surface.

16. The golf club head as claimed in claim 15, wherein a depression is formed in the external surface in the sole, and the external rib is disposed in the depression.

* * * * *